US008269406B2

(12) United States Patent
Haacke et al.

(10) Patent No.: US 8,269,406 B2
(45) Date of Patent: Sep. 18, 2012

(54) MERCURY-FREE-HIGH-PRESSURE GAS DISCHARGE LAMP

(75) Inventors: Michael Haacke, Aachen (DE); Marc F. R. Janssen, Kasterlee (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 1585 days.

(21) Appl. No.: 10/503,426

(22) PCT Filed: Jan. 30, 2003

(86) PCT No.: PCT/IB03/00313

§ 371 (c)(1),
(2), (4) Date: Aug. 3, 2004

(87) PCT Pub. No.: WO03/067628

PCT Pub. Date: Aug. 14, 2003

(65) Prior Publication Data

US 2005/0116608 A1 Jun. 2, 2005

(30) Foreign Application Priority Data

Feb. 6, 2002 (DE) ..... 102 04 691

(51) Int. Cl.

| | |
|---|---|
| ***H01J 63/04*** | (2006.01) |
| ***H01J 5/16*** | (2006.01) |
| ***H01J 61/35*** | (2006.01) |
| ***H01J 17/16*** | (2012.01) |
| ***H01K 1/32*** | (2006.01) |

(52) U.S. Cl. ..... 313/489; 313/110; 313/635

(58) Field of Classification Search ..... 313/110, 313/112, 489, 635

See application file for complete search history.

(56) References Cited

U.S. PATENT DOCUMENTS

| | | | | | |
|---|---|---|---|---|---|
| 3,400,288 | A | * | 9/1968 | Groth | 313/47 |
| 3,842,304 | A | * | 10/1974 | Beyer et al. | 313/44 |
| 4,071,798 | A | * | 1/1978 | Hammond | 313/18 |
| 4,281,267 | A | * | 7/1981 | Johnson | 313/25 |
| 4,446,397 | A | * | 5/1984 | Johnson et al. | 313/25 |
| 4,467,238 | A | * | 8/1984 | Silverstein et al. | 313/25 |
| 4,663,557 | A | * | 5/1987 | Martin et al. | 313/112 |
| 4,678,960 | A | * | 7/1987 | Reiling | 313/25 |
| 4,837,478 | A | * | 6/1989 | Anzai et al. | 313/112 |
| 4,987,343 | A | * | 1/1991 | Kosmatka et al. | 315/82 |
| 5,021,718 | A | * | 6/1991 | Maya et al. | 315/358 |
| 5,032,757 | A | * | 7/1991 | Witting | 313/44 |
| 5,059,865 | A | * | 10/1991 | Bergman et al. | 315/82 |

(Continued)

FOREIGN PATENT DOCUMENTS

GB 2080020 A * 1/1982

(Continued)

*Primary Examiner* — Anastasia Midkiff

(57) ABSTRACT

A mercury-free high-pressure gas discharge lamp (HID [high intensity discharge] lamp) is described which is provided for use in automotive technology. To achieve improved lamp characteristics, in particular a substantially equal luminous efficacy in comparison with lamps of the same power and a mercury-free gas filling, as well as a highest possible burning voltage, the discharge vessel (1) is provided in its wall regions (10) which are lowermost in the operational position with a coating (15) which reflects at least a portion of the infrared radiation generated during operation, such that the temperature of the coldest spots, and in particular of the light-generating substances collected there, is raised, with the result that the light-generating substances can enter the gas phase in sufficient quantities also without mercury, and in particular with the use of a metal halide as a voltage-gradient generator.

19 Claims, 2 Drawing Sheets

U.S. PATENT DOCUMENTS

| | | | | |
|---|---|---|---|---|
| 5,498,927 | A * | 3/1996 | Vervecken et al. | 313/623 |
| 5,578,892 | A * | 11/1996 | Whitman et al. | 313/112 |
| 5,587,626 | A * | 12/1996 | Parham et al. | 313/634 |
| 5,942,851 | A * | 8/1999 | Filmer et al. | 313/623 |
| 5,952,768 | A * | 9/1999 | Strok et al. | 313/110 |
| 5,982,078 | A * | 11/1999 | Krisl et al. | 313/112 |
| 6,639,341 | B1 * | 10/2003 | Sakai et al. | 313/25 |
| 6,967,443 | B2 * | 11/2005 | Bigio et al. | 313/635 |
| 2002/0027421 | A1 * | 3/2002 | Kaneko et al. | 313/637 |
| 2002/0047525 | A1 * | 4/2002 | Scholl et al. | 313/637 |
| 2002/0135304 | A1 * | 9/2002 | Honda et al. | 313/634 |
| 2003/0057833 | A1 * | 3/2003 | Lapatovich et al. | 313/595 |
| 2003/0077459 | A1 * | 4/2003 | Vitt et al. | 428/432 |
| 2005/0040763 | A1 * | 2/2005 | Yoon et al. | 313/635 |

FOREIGN PATENT DOCUMENTS

JP 2000348678 A * 12/2000

* cited by examiner

MERCURY-FREE-HIGH-PRESSURE GAS DISCHARGE LAMP

The invention relates to a high-pressure gas discharge lamp (HID [high intensity discharge] lamp) which is in particular free from mercury and suitable for use in automobile technology.

Conventional high-pressure gas discharge lamps contain on the one hand a discharge gas (usually a metal halide such as sodium iodide or scandium iodide) which is the actual light-emitting material (light generator), and on the other hand mercury which primarily serves to form a voltage gradient and has the essential function of enhancing the efficacy and burning voltage of the lamp.

Lamps of this kind have come into widespread use because of their good properties and they are increasingly applied also in the field of automobile technology. It is also partly required in particular for this application, however, that the lamps should contain no mercury for environmental reasons.

A general problem with mercury-free lamps is that a given lamp power in continuous operation results in a lower burning voltage and accordingly in a higher lamp current and a lower luminous efficacy.

U.S. Pat. No. 5,952,768 discloses a discharge lamp with a transparent, preferably dichroic coating which absorbs ultraviolet radiation and preferably reflects infrared radiation so as to bring the coldest regions of the lamp to a higher temperature. The object of this is to maintain a higher metal halide vapor pressure and to improve the efficacy, life, and color properties of the lamp.

Among the disadvantages of this is that this lamp still contains mercury in its gas filling, so that it does not comply with the above requirements relating to its use in automotive technology.

It is an object of the invention to provide a high-pressure gas discharge lamp which has a mercury-free gas filling and which is capable of achieving a luminous efficacy substantially corresponding to that of lamps which do contain mercury.

A further object is to provide a high-pressure gas discharge lamp which has a mercury-free gas filling and has a higher burning voltage than is generally achievable with mercury-free lamps.

In particular, the object is to provide a high-pressure gas discharge lamp with which at least one of the two objects mentioned above (higher efficacy and higher burning voltage) can be achieved without the necessity of increasing lamp power or enlarging the external dimensions of the outer bulb of the lamp.

It is also an object to provide a mercury-free high-pressure gas discharge lamp which has a lumen maintenance usual for automotive applications, i.e. in which the luminous decrement over lamp life shows a similar gradient as in lamps which do contain mercury.

Finally, the object is in particular to provide a high-pressure gas discharge lamp which is suitable for use in automotive technology.

According to claim 1, the object is achieved with a mercury-free high-pressure gas discharge lamp having a discharge vessel which comprises an at least substantially infrared-reflecting coating on its wall portions which are lowermost in the operational position, the dimensioning of said coating being chosen such that after switching-on of the lamp the temperature of the light-generating substances collected on the coated wall portions is increased to the extent that said substances enter the gaseous state at least substantially.

The temperature rise is substantially achieved in that the infrared radiation issuing from the light arc discharge is incident on the coated wall portions and is reflected there, so that said radiation passes twice through the light-generating substances, which thus are heated correspondingly more strongly. The heating may in addition be caused to a minor degree by any portions of the infrared radiation absorbed by the coating, whereby the coated wall portions, and thus also the light-generating substances deposited thereon, are additionally heated.

To optimize the lamp properties and to achieve as high a burning voltage and luminous efficacy as possible, the coating is accordingly dimensioned such that the light-generating substances enter the gaseous state as much as possible, preferably fully.

It can also be achieved in this manner inter alia that either mercury can be omitted without any replacement, or that an alternative voltage-gradient generator, for example a suitable metal halide which is less environmentally unfriendly, is used instead of mercury, provided that in any case the light-generating substances enter the gas phase in a sufficient quantity owing to the achieved higher temperature of the coldest spots, whereby the luminous efficacy and the burning voltage of the lamp are further enhanced. This may additionally be supported by the introduction of a rare gas (in particular xenon) with which the gas pressure in the discharge space is increased.

A further advantage of this solution is that it can also be applied to discharge lamps with mercury in their gas fillings, the efficacy of which can be considerably increased thereby.

It should be noted here that a high-pressure gas discharge lamp is known from U.S. Pat. No. 4,281,267 in which the discharge vessel is provided with an approximately semicircular reflecting coating, which may comprise zirconium oxide, in the regions of the electrodes, i.e. the axial ends. The object of this coating is to reduce multiple internal reflections. In the case of lamps with flat pinches, the coating provided on the latter in addition serves to reduce heat radiation. The efficacy and the luminous flux of the lamp is to be increased thereby, i.e. a suitable vapor pressure is to be maintained in the lamp.

This publication, however, does not take into account or even mention the problems connected with an omission of mercury. Finally, the particulars important for use in automotive technology relating to the incorporation situation, the coating of the lamp for cooperation with the reflector (the light arc, in particular the hot spots, and the free ends of the electrodes must not be screened off from the reflector), and the requirement for as constant an outer shape of the lamp as possible are not taken into account, so that this publication is regarded as irrelevant.

The dependent claims relate to advantageous further embodiments of the invention.

It is possible to influence the temperature balance in a desired manner by means of the types of dimensioning mentioned in claim 2. Herein the location of the temperature rise is determined by the location or extent of the coating (there where the light-generating substances are at least substantially deposited), while the degree of the temperature rise is adjusted by the packing density and by the size of the particles in the coating material, as well as the thickness of the coating.

The embodiment of claim 3 has the particular advantage that light-reflecting properties can be achieved thereby—for example in the case of a metal coating—, so that an improved focusing of the radiated light in the manner of a primary and a secondary reflector can be achieved in co-operation with an additional main reflector.

The embodiment of claim 4 has the particular advantage that the manufacturing process of the lamp itself need not be changed, but that an additional manufacturing step is used for providing the coating on the lamp which is otherwise manufactured in the usual manner. In addition, the reflected infrared radiation passes not only twice through the light-generating substance, but also twice through the coated wall regions, to which regions the coldest spot also belongs, as was noted above, so that also the temperature thereof is raised.

The embodiment of claim 5 is capable of preventing light-generating substances from migrating into the pinches upon switching-on of the lamp and the accompanying heating-up, which would cause corrosion there of the molybdenum foils connected to the respective electrodes.

Claim 6 describes an embodiment with a preferred, particularly effective coating.

Claims 7 and 8 relate to voltage-gradient generators which are to be preferably used instead of mercury and by means of which a particularly good luminous efficacy of the lamp can be achieved, while claim 9 describes an alternative possibility for achieving this object, in particular a higher efficacy and burning voltage.

Further particulars, characteristics, and advantages of the invention will become apparent from the following description of preferred embodiments, which is given with reference to the drawing, in which:

FIGS. 1 to 3 show high-pressure gas discharge lamps according to the invention in the operational state. The lamps each comprise a discharge vessel 1 of quartz glass which encloses a discharge space 2 and which merges into quartz glass portions (pinches) 5 at its mutually opposed ends.

Figure 1:
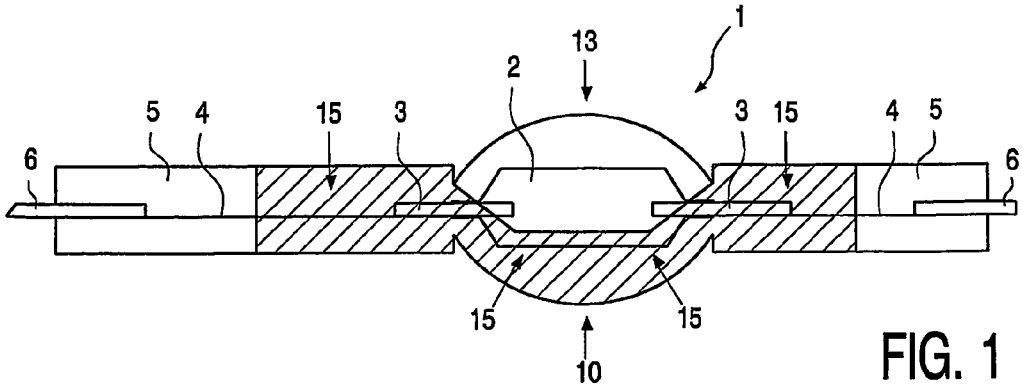
FIG. 1 is a diagrammatic side elevation of a first embodiment.

The discharge space 2 is filled with a gas which is composed of a discharge gas emitting light radiation through excitation or discharge as well as preferably a voltage-gradient generator, which may both be chosen from the group of the metal halides.

The light-generating substance is, for example, sodium iodide and/or scandium iodide, while the voltage-gradient generator used may be, for example, zinc iodide and/or other substances instead of mercury.

Alternatively or additionally to the voltage-gradient generator, certain quantities of rare gases (for example xenon) may be introduced into the discharge space 2 so as to increase the gas pressure and thus the efficacy and the burning voltage.

The free ends of electrodes 3, which are manufactured from a material with as high a melting temperature as possible such as, for example, tungsten, project into the discharge space 2 from the mutually opposed ends thereof.

The respective other ends of the electrodes 3 are each connected to an electrically conductive tape or foil 4, in particular a molybdenum foil, via which an electrical connection is achieved between the connection terminals 6 of the discharge lamp and the electrodes 3. These ends of the electrodes 3 and the electrically conductive foil 4 are embedded in the pinches 5.

The pinches 5 are preferably symmetrically arranged with respect to the discharge vessel 1, i.e. they lie on the longitudinal axis thereof. This has the advantage that the external dimensions of the outer bulb of the lamp according to the invention need not be changed, which is of particular importance especially for the use of these lamps in motor vehicle headlights. In addition, the manufacture of a lamp with symmetrical pinches is simpler and thus more cost-effective.

An arc discharge (luminous arc) is excited between the tips of the electrodes 3 in the operational state of the lamp.

As was noted above, the gas filling of the high-pressure gas discharge lamp according to the invention preferably comprises one or several suitable metal halides as a voltage-gradient generator instead of mercury. Said halides, however, have a comparatively low partial vapor pressure, which renders it necessary to change the temperature balance in the discharge vessel 1 so as to achieve substantially the same luminous efficacy (luminous flux) as with the use of mercury as well as the highest possible burning voltage. Upon switching-on of the lamp, in fact, it is necessary in particular to raise the temperature of the light-generating substances, which have accumulated in the solid state on the wall regions 10 lowermost in the operational position of the switched-off lamp, to such a degree that they enter the gas phase in a sufficient quantity in the discharge space 2 after switching-on for achieving a luminous efficacy and burning voltage which are as high as possible. A further difficulty here is that the lowermost wall regions 10 are the coldest regions in the operational state of the lamp.

The change in the temperature balance should be achieved here without an increase in lamp power, if at all possible.

These objects are substantially achieved by the coatings 15 (shown hatched) described below, which are preferably provided on the outer surfaces of the discharge vessel 2 and on portions of the pinches 5, or on the inner or outer surfaces of an outer bulb (not shown) which surrounds the discharge vessel.

It is preferred to provide the coating 15 on the discharge vessel 2 because the edge of the coating can be attuned more exactly to the positions of the electrode tips and of the arc discharge formed between them there, which tips must not be screened off (in the desired radiation direction) by the coating.

As is shown in FIGS. 1 to 4, the coating 15 extends substantially only over the wall regions 10 which are lowermost in the operational position and over portions of the side wall of the discharge vessel 1, whereas the upper wall regions 13 have no coating. The portions of the pinches 5 adjoining the discharge vessel 2, by contrast, are provided with the coating 5 over their entire circumference.

In detail, the coating 15 in the first embodiment of FIG. 1 extends over the lower wall regions 10 and the lateral walls of the discharge vessel 1, the coating edge extending below a connecting line between the two electrodes 3 and parallel to this line. The edge of the coating then extends upwards in the direction of the transition between the discharge vessel 1 and the pinch 5 in the region of each electrode tip, said pinch being finally fully surrounded by the coating 15.

Figure 2:
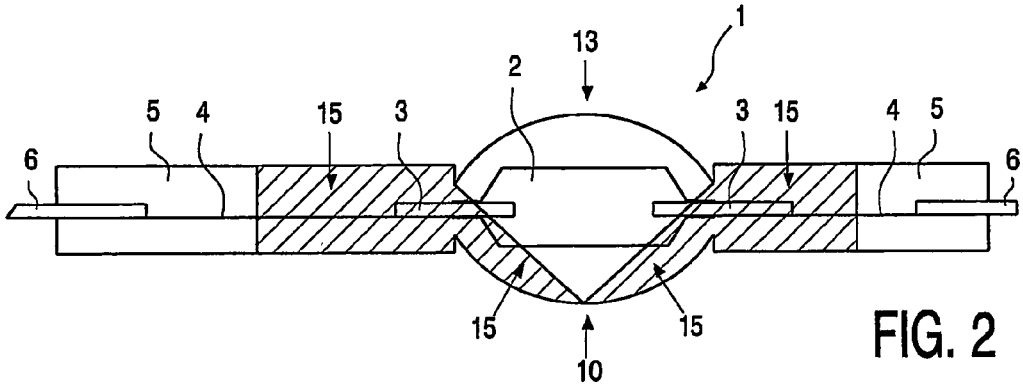
FIG. 2 is a diagrammatic side elevation of a second embodiment.

In the second embodiment shown in FIG. 2, the edge of the coating 15 extends over the lateral walls of the discharge vessel 1 substantially in a V-shape from the uppermost transition point between the discharge vessel 1 and the pinch 5 in the direction of the lowermost point of the discharge vessel 1.

Figure 3:
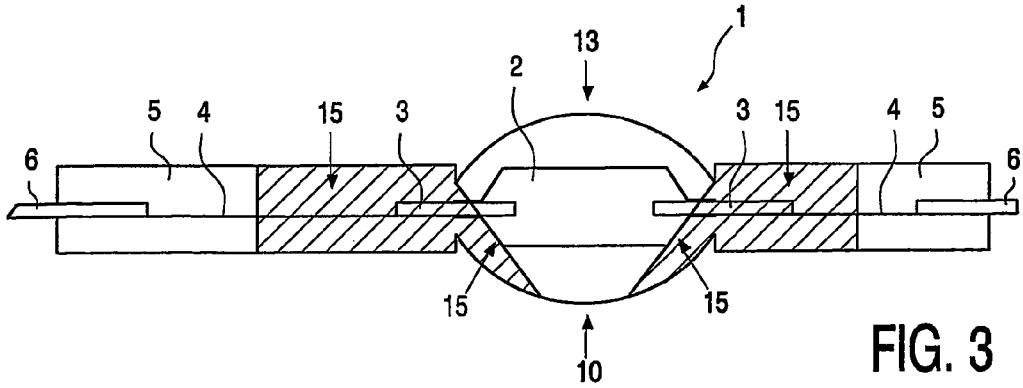
FIG. 3 is a diagrammatic side elevation of a third embodiment.
Figure 4:
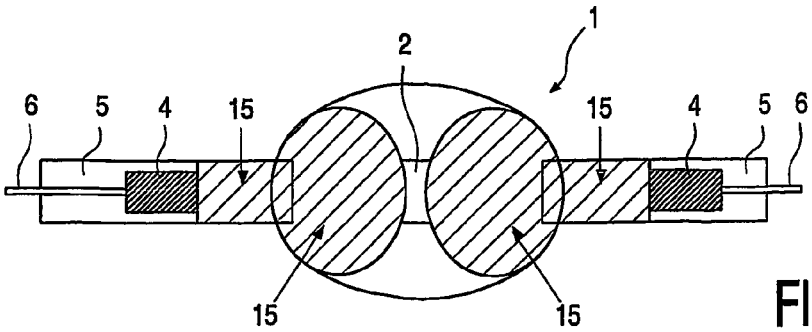
FIG. 4 is a diagrammatic elevation of the third embodiment viewed from below.

In the third embodiment shown in FIGS. 3 and 4, the edge of the coating 15 is directed more steeply downwards at the lateral walls of the discharge vessel 1 away from said transition point, such that a portion of the lower wall region 10 is not covered by the coating. This is visible in particular in FIG. 4, which is a plan view of the lower side of the lamp.

Besides these three examples, edge gradients are obviously possible for the coating which are modifications of the gradients shown, i.e. in which, for example, the distance of the edge of FIG. 1 to the connecting line between the electrodes is greater or smaller, or the steepness of the gradient of the edge of FIGS. 2 and 3 is greater or smaller, or in which the edges are not straight but curved.

It should additionally be heeded in the shaping of the coating, in particular if the coating is to be substantially impermeable to visible light, that the light arc, in particular its hottest location (hot spot), as well as the electrode tips are not hidden or screened off with respect to a reflector.

The coating is substantially formed by zirconium oxide ($ZrO_2$). Alternative materials may be used, however, for example $Nb_2O_5$ and $Ta_2O_5$, which have an even better infrared-reflecting power than $ZrO_2$, but which are comparatively expensive. Another possibility, finally, would be the use of $SiO_2$ in crystalline form.

The infrared radiation originating from the arc discharge is reflected by the coating for a major portion and is absorbed for a smaller portion or not at all. The coated wall portions and the light-generating substance deposited thereon are accordingly heated more strongly by the double passage of the infrared radiation than the portions free from coating during lamp operation. The reflectivity, and accordingly the degree of heating, is essentially determined by the composition of the coating 15, in particular its packing density and particle size, and also substantially by its thickness.

The coating 15 is provided on those regions and with such a packing density, particle size, and thickness, that the light-generating substance accumulated on the lowermost wall regions 10 and said wall regions themselves, which are also the coldest spots, are heated as strongly as possible after switching-on of the lamp.

A luminous efficacy of the lamp can be achieved in particular with the coating 15 thus dimensioned such as had been possible until now substantially only with gas fillings containing mercury. Furthermore, the spectral characteristics and the color point of the generated light and the lumen maintenance correspond substantially to those of lamps which do contain mercury, which is of particular importance for automotive applications.

The burning voltage of the lamp is also substantially increased by the coating 15 in comparison with known mercury-free lamps, again in dependence on the layer thickness, particle size, and packing density.

A suitable coating of certain regions, possibly with different layer thicknesses, packing densities, and particle sizes, renders it possible also to achieve a particularly homogeneous temperature distribution over the wall of the discharge vessel 1 and the pinches 5.

To clarify the improvements achievable with the lamp according to the invention, various comparative examples will be given below of mercury-free high-pressure gas discharge lamps which contain zinc iodide as a voltage-gradient generator. The measured values listed below were obtained from lamps without outer bulbs. The incremental values listed in the fourth column remain substantially the same with the use of an outer bulb.

Table 1 shows the luminous efficacy for various lamp types without coating in comparison with the luminous efficacy of said lamps with a zirconium oxide coating provided in accordance with FIGS. 1 to 3, and the respective differences between these luminous efficacies.

TABLE 1

| | without $ZrO_2$ | with $ZrO_2$ | |
|---|---|---|---|
| Lamp type | Δ [lm/W] | Δ [lm/W] | Δ [lm/W] |
| B15T-1 | 54.4 | 61.0 | 6.6 |
| B15T-2 | 55.4 | 59.8 | 4.4 |
| B16T-1 | 78.8 | 85.5 | 6.7 |
| B16T-2 | 74.3 | 80.2 | 5.9 |
| B16T-10 | 76.2 | 85.4 | 9.2 |
| B18T-5 | 67.2 | 73.2 | 6.0 |
| B18T-6 | 70.9 | 75.1 | 4.2 |
| B18T-9 | 67.4 | 71.9 | 4.5 |
| P1-4 | 83.2 | 88.9 | 5.7 |
| A3P-7 | 63.2 | 68.9 | 5.7 |
| A3P-9 | 62.9 | 69.5 | 6.6 |

Table 2 below juxtaposes the burning voltages of these lamp types without and with the coating according to the invention mentioned above, as well as the differences between the two burning voltages resulting therefrom.

TABLE 2

| | without $ZrO_2$ | with $ZrO_2$ | |
|---|---|---|---|
| Lamp type | U [V] | U [V] | ΔU [V] |
| B15T-1 | 49.0 | 51.0 | 2.0 |
| B15T-2 | 45.0 | 53.2 | 8.2 |
| B16T-1 | 33.0 | 34.7 | 1.7 |
| B16T-2 | 32.8 | 35.6 | 2.8 |
| B16T-10 | 31.9 | 34.5 | 2.6 |
| B18T-5 | 44.3 | 47.1 | 2.8 |
| B18T-6 | 42.1 | 47.7 | 5.6 |
| B18T-9 | 43.4 | 47.2 | 3.8 |
| P1-4 | 34.2 | 37.0 | 2.8 |
| A3P-7 | 46.8 | 54.5 | 7.7 |
| A3P-9 | 48.6 | 55.2 | 6.6 |

Table 3, finally, lists the temperatures of the coldest spots for the same lamp types without coating and with the coating according to the invention mentioned above, with the resulting temperature differences.

TABLE 3

| | without $ZrO_2$ | with $ZrO_2$ | |
|---|---|---|---|
| Lamp type | $T_{min}$ [° C.] | $T_{min}$ [° C.] | $\Delta T_{min}$ [° C.] |
| B15T-1 | 863 | 869 | 6 |
| B15T-2 | 856 | 868 | 12 |
| B16T-1 | 856 | 866 | 10 |
| B16T-2 | 856 | 871 | 15 |
| B16T-10 | 844 | 862 | 18 |
| B18T-5 | 833 | 853 | 20 |
| B18T-6 | 827 | 857 | 30 |
| B18T-9 | 831 | 858 | 27 |
| P1-4 | 835 | 852 | 17 |
| A3P-7 | 850 | 871 | 21 |
| A3P-9 | 840 | 865 | 25 |

A luminous efficacy and/or burning voltage satisfactory for certain applications may be achieved with the coating 15 according to the invention also if mercury is omitted without replacement, if so desired, i.e. without the use of a voltage-gradient generator, or if certain quantities of rare gases (for example xenon) are introduced into the discharge space 2 as an alternative to the voltage-gradient generator so as to raise the gas pressure.

Figure 5:
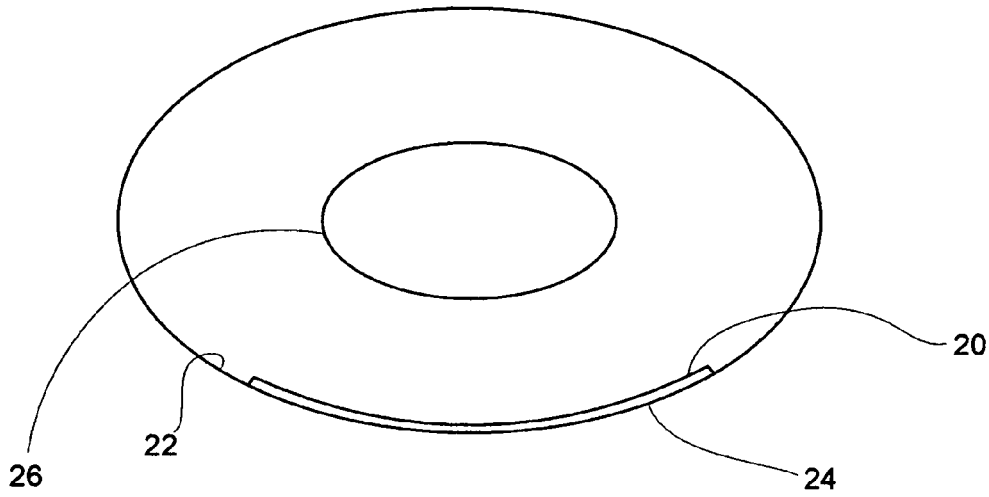
FIG. 5 is a schematic diagram of a fourth embodiment.
Figure 6:
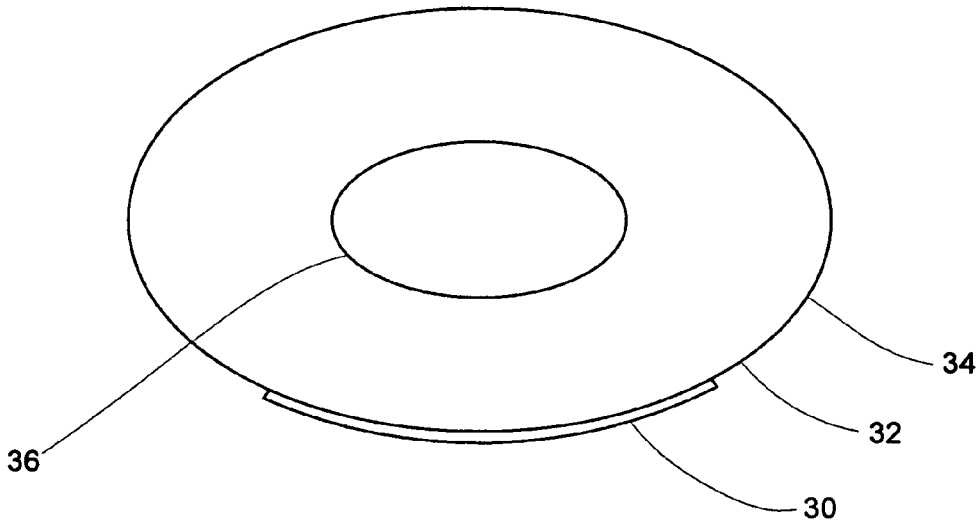
FIG. 6 is a schematic diagram of a fifth embodiment.

It should finally be pointed out that the principle of the invention, by which the temperature of the coldest spot of the discharge vessel is raised, is obviously also applicable to lamps which do contain mercury and in which the environmental disadvantages of mercury are accepted. In this case, such a temperature rise may serve, for example, to increase the luminous efficacy or to reduce the lamp power for a given efficacy. FIGS. 4 and 5 show fourth and fifth embodiments of the invention, respectively. In the embodiment of *Fig.* 4, the infrared-reflecting coating 20 is provided on a portion of the inner surface 22 of an outer bulb 24 surrounding the discharge vessel 26 which is lowermost in the operational position. In the embodiment of FIG. 5, the infrared-reflecting coating 30 is provided on a portion of the outer surface 32 of an outer bulb 34 surrounding the discharge vessel 36 which is lowermost in the operational position.

The invention claimed is:

1. A mercury-free high-pressure discharge lamp having a discharge vessel which comprises an at least substantially infrared-reflecting coating on lower wall portions of the discharge vessel in an operational position and not substantially on wall portions opposite the lower wall portions, wherein an upper edge of the coating in the operational position extends in a declining substantially straight line towards a center portion of the discharge vessel until reaching a bottom portion of the discharge vessel, a dimensioning of said coating being chosen such that after switching-on of the lamp, a temperature of light-generating substances collected on the coated wall portions is increased to an extent that said substances enter the gaseous state at least substantially.

2. The high-pressure gas discharge lamp as claimed in claim 1, wherein the coating is comprised of particles and wherein the dimensioning of the coating is given by its surface area and/or thickness and/or particle size and/or packing density of the particles.

3. The high-pressure gas discharge lamp as claimed in claim 1, wherein the coating is substantially impermeable to visible light.

4. The high-pressure gas discharge lamp as claimed in claim 1, wherein the coating is provided on regions of pinches which adjoin the discharge vessel.

5. The high-pressure gas discharge lamp as claimed in claim 1, wherein the coating is formed from zirconium oxide.

6. The high-pressure gas discharge lamp as claimed in claim 1, which comprises in its gas filling a voltage-gradient generator in the form of one or several metal halides.

7. The high-pressure gas discharge lamp as claimed in claim 6, wherein the voltage-gradient generator comprises zinc iodide.

8. The high-pressure gas discharge lamp as claimed in claim 1, where the gas filling comprises rare gases in amounts effective to increase the gas pressure and to enhance the luminous efficacy of the lamp.

9. A lighting unit, in particular for motor vehicle headlights, comprising the high-pressure gas discharge lamp as claimed in claim 1.

10. The high-pressure gas discharge lamp as claimed in claim 8, wherein the rare gas comprises xenon.

11. A mercury-free high-pressure discharge lamp having a discharge vessel, an outer envelope surrounding the discharge vessel, and comprising an at least substantially infrared-reflecting coating, the coating being provided on lower wall portions and not substantially on wall portions opposite the lower wall portions, in an operational position, of outer surfaces of the discharge vessel or on lower portions and not substantially on portions opposite the lower portions, in the operational position, of inner or outer surfaces of the outer envelope surrounding the discharge vessel, wherein an upper edge of the coating in the operational position extends in a declining substantially straight line towards a center portion of the discharge vessel until reaching a bottom portion of the discharge vessel, the dimensioning of said coating being chosen such that after switching-on of the lamp the temperature of light-generating substances collected on the wall portions of the discharge vessel is increased to an extent that said substances enter the gaseous state at least substantially.

12. The high-pressure gas discharge lamp as claimed in claim 1, wherein the coating in the operational position is symmetrically disposed about the center portion of the discharge vessel.

13. The high-pressure gas discharge lamp as claimed in claim 1, wherein the upper edge of the coating in the operational position forms a V-shape with a bottom portion of the V-shape positioned substantially towards the center portion.

14. The high-pressure gas discharge lamp as claimed in claim 11, wherein the coating in the operational position is symmetrically disposed about the center portion of the discharge chamber.

15. The high-pressure gas discharge lamp as claimed in claim 11, wherein the upper edge of the coating in the operational position forms a V-shape with a bottom portion of the V-shape positioned substantially towards the center portion.

16. The high-pressure gas discharge lamp as claimed in claim 12, wherein symmetrical portions of the coating are joined by a substantially horizontal upper edge of the coating.

17. The high-pressure gas discharge lamp as claimed in claim 12, wherein symmetrical portions of the coating extend to a bottom portion of the discharge vessel without touching another symmetrical portion of the coating.

18. A mercury-free high-pressure discharge lamp having a discharge vessel, an outer envelope surrounding the discharge vessel, and comprising an at least substantially infrared-reflecting coating, the coating being provided on lower wall portions and not substantially on wall portions opposite the lower wall portions, in an operational position, of outer surfaces of the discharge vessel or on lower portions and not substantially on portions opposite the lower portions, in the operational position, of inner or outer surfaces of the outer envelope surrounding the discharge vessel, wherein the coating forms two substantially circular sections when viewed from below the lamp in the operational position, the dimensioning of said coating being chosen such that after switching-on of the lamp the temperature of light-generating substances collected on the wall portions of the discharge vessel is increased to an extent that said substances enter the gaseous state at least substantially.

19. The high-pressure gas discharge lamp as claimed in claim 18, wherein the coating is symmetrically disposed about a center portion of the lamp.

* * * * *